US006425259B2

(12) United States Patent
Nelson et al.

(10) Patent No.: US 6,425,259 B2
(45) Date of Patent: Jul. 30, 2002

(54) REMOVABLE ICE BUCKET FOR AN ICE MAKER

(75) Inventors: Mark H. Nelson, Beavercreek, OH (US); Daniel H. Quinlan, Stevensville, MI (US); Kenneth Todd Shelley, St. Joseph, MI (US); Sandra C. Steward, Benton Harbor, MI (US); Jim J. Pastryk, Sawyer, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/760,414

(22) Filed: Jan. 12, 2001

Related U.S. Application Data

(63) Continuation-in-part of application No. 09/482,397, filed on Jan. 12, 2000, now Pat. No. 6,286,324, which is a continuation-in-part of application No. 09/221,770, filed on Dec. 28, 1998, now Pat. No. 6,050,097, said application No. 09/760,414, is a continuation-in-part of application No. 29/126,155, filed on Jul. 11, 2000, now Pat. No. Des. 447,149.

(51) Int. Cl.[7] ..... F25C 5/18
(52) U.S. Cl. ..... 62/344; 220/771; 222/466
(58) Field of Search ..... 62/344; 220/771, 220/772; 222/466

(56) References Cited

U.S. PATENT DOCUMENTS

| | | | | | |
|---|---|---|---|---|---|
| 806,885 | A | * | 12/1905 | Focht | 220/772 |
| 931,266 | A | * | 8/1909 | Buchmaier | 220/772 |
| 1,331,409 | A | * | 2/1920 | Barnett | 220/771 |
| 2,726,795 | A | * | 12/1955 | Billock et al. | 222/466 |
| 4,125,207 | A | * | 11/1978 | Ernst et al. | 220/771 |
| 4,942,979 | A | | 7/1990 | Linstromberg | 221/75 |
| 5,226,574 | A | * | 7/1993 | Durinzi, Jr. | 220/771 |
| 5,921,103 | A | * | 7/1999 | Hilsinger | 62/344 |

* cited by examiner

*Primary Examiner*—William E. Tapolcai
(74) *Attorney, Agent, or Firm*—Robert O. Rice; Stephen D. Krefman; Joel M. Van Winkle

(57) ABSTRACT

A removable ice bucket for an ice making system for a refrigerator and more particularly a removable ice bucket disposable in a refrigerator for receipt of ice pieces from an ice maker disposed in the freezer compartment of the refrigerator.

The ice bucket has a base and a plurality of upwardly extending side walls cooperating to form a storage bin. A first handle is formed in an upper portion of a first side walls and a second handle is formed in a lower portion of a second of said side walls. A spout is formed above the first handle. The handles facilitate quick and sanitary removal of the ice bucket from the freezer and dispensing of the ice pieces.

16 Claims, 8 Drawing Sheets

REMOVABLE ICE BUCKET FOR AN ICE MAKER

The present application is a continuation-in-part application of application Ser. No. 09/482,397 entitled "ICE LEVEL SENSING SYSTEM FOR AN ICE MAKER", filed on Jan. 12, 2000, now U.S. Pat. No. 6,286,324 issued Sep. 11, 2001 which is a continuation-in-part of application Ser. No. 09/221,770, entitled "ICE MAKING AND STORAGE SYSTEM FOR A REFRIGERATOR", filed on Dec. 28, 1998, now U.S. Pat. No. 6,050,097 issued Apr. 4, 2000.

The present application is also a continuation-in-part application of application Ser. No. 29/126,155 entitled "REMOVABLE ICE BUCKET", filed on Jul. 11, 2000, now U.S. Pat. No. D447,493 issued Sep. 4, 2001.

The specifications and drawings of the three above listed parent applications are hereby incorporated herein by reference.

BACKGROUND OF THE INVENTION

1. Field of the Invention

The invention relates to a removable ice bucket for an ice making system for a refrigerator and more particularly a removable ice bucket disposable in a door of a refrigerator for use with an ice maker disposed in the freezer compartment of the refrigerator.

2. Description of Related Art

Automatic ice making systems for use in a home refrigerator are well known. Typically, ice making systems include an ice maker mounted within the freezer compartment of the refrigerator and an ice storage receptacle or bin supported beneath the ice maker for receiving the formed ice from the ice maker. The ice maker is commonly mounted within the freezer compartment adjacent the side or rear wall of the freezer compartment such that water and power can be readily supplied to the ice maker. The ice storage receptacle is supported by a shelf structure beneath the ice maker within the freezer compartment. The ice storage receptacle generally extends across the freezer compartment and has a front end adjacent the freezer door. U.S. Pat. No. 4,942,979, to Linstromberg et al. is an example of a prior art ice making system. While many such ice makers provide for removable ice storage trays, they are strictly designed for capturing and holding the ice and are not adapted to be easy used remotely from the refrigerator for serving the ice.

The present invention addresses the need for easy and sanitary delivery of the ice remotely from the refrigerator by providing an ice bucket adapted for easy removal and reinstallation and for convenient one handed dispensing of the ice from the ice bucket.

SUMMARY OF THE INVENTION

The present invention is directed to door mounted ice storage bin systems for use in the freezer compartment of a refrigerator and in particular to an easily removable dispensing ice bucket.

The present invention is more particularly directed to an ice bucket removably mounted to the freezer compartment access door for use in conjunction with an ice maker disposed within the freezer compartment.

More particularly, according to the present invention, an ice storage bucket or bin is removably mounted to the door below the ice maker for receiving ice pieces from the ice maker.

The ice bucket or bin has a first handle disposed low on one of its sides and a second handle disposed high on its opposite side to facilitate removal and reinstallation of the ice bucket and to facilitate tilting the ice bucket for dispensing of the ice. A spout is preferably formed above the second handle to direct ice cubes dispensed from the ice bucket. A release button for releasing the ice bucket from the door is preferably disposed close to the second handle to further facilitate rapid removal of the ice bucket from the door.

DESCRIPTION OF THE PREFERRED EMBODIMENTS

Figure 2:
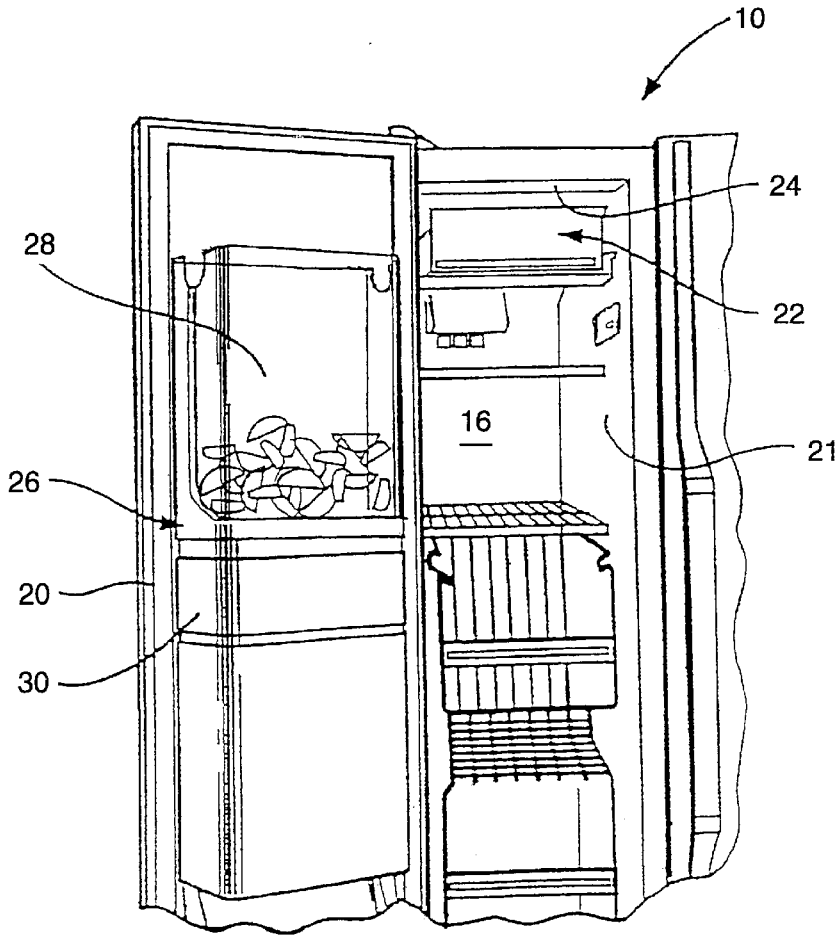
FIG. 2 is a fragmentary perspective view illustrating the ice storing and dispensing system within the freezer compartment of the refrigerator apparatus with the freezer door open.
Figure 3:
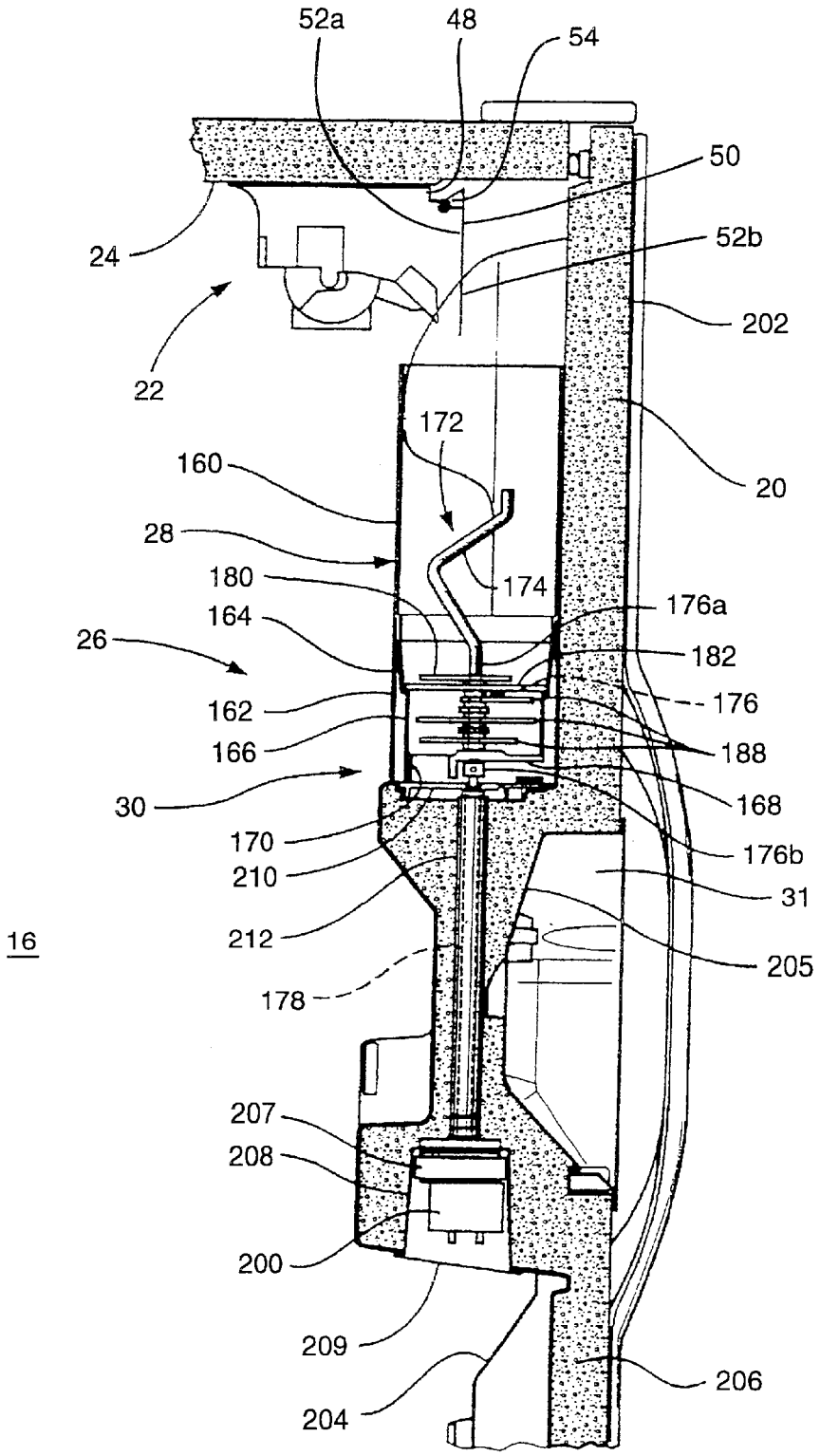
FIG. 3 is a fragmentary, side sectional view of the ice storing and dispensing system of FIG. 1.
Figure 4:
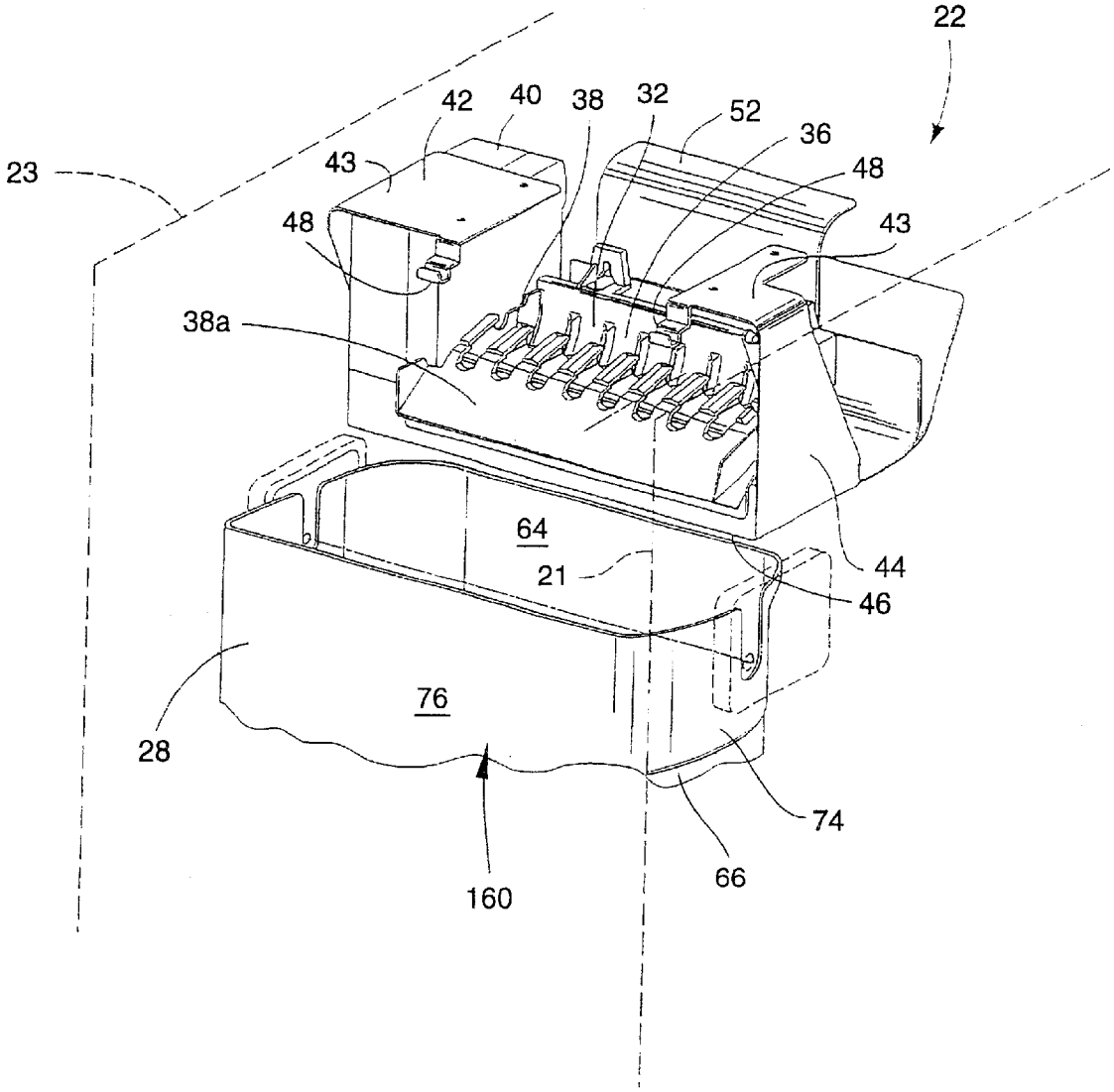
FIG. 4 is a fragmentary, perspective view of the ice storage and dispensing wherein the front cover of the ice maker has been removed and illustrating the ice bucket of the present invention, as disclosed in a parent application.
Figure 5:
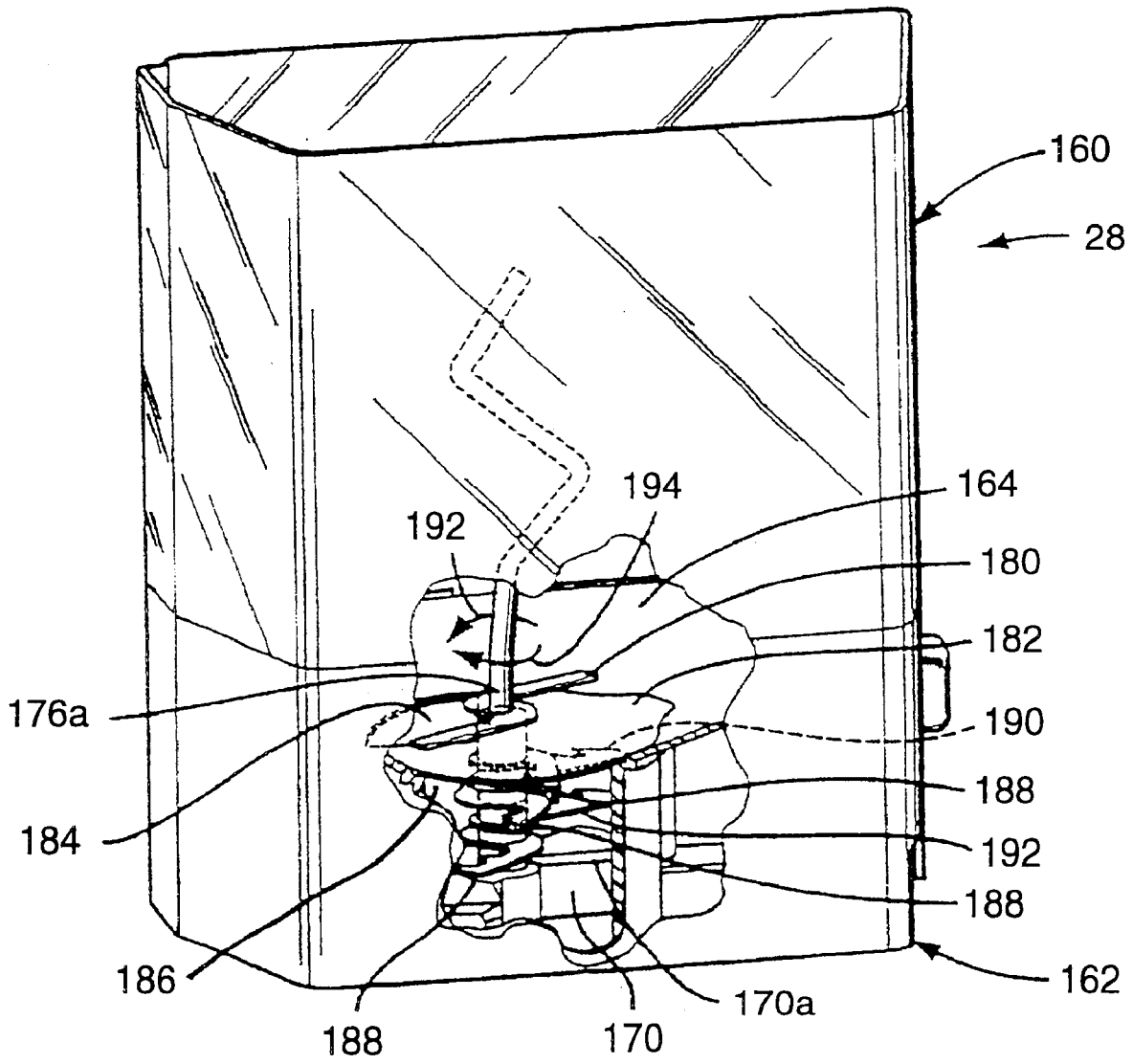
FIG. 5 is a fragmentary, enlarged, perspective view of the ice storage bin of FIG. 1, with a cut away portion illustrating the ice crusher assembly, as disclosed in a parent application.

The above drawings were taken without alteration from the three parent applications. Since the parent applications did not claim the present invention, FIGS. 2, 3 and 5 of the drawing show an unclaimed first embodiment of ice bucket, while FIGS. 4, and 6–10 show an ice bucket having made according to the present invention. FIGS. 2, 3, and 5 have been included, however, for purposes of background to illustrate the environment of the preferred embodiment of the ice bucket of the present invention. It will be appreciated by those skilled in the art the ice bucket of the present invention can be used in conjunction with other ice maker or freezer compartment configurations.

1. Description of the Refrigerator and Ice Maker

Figure 1:
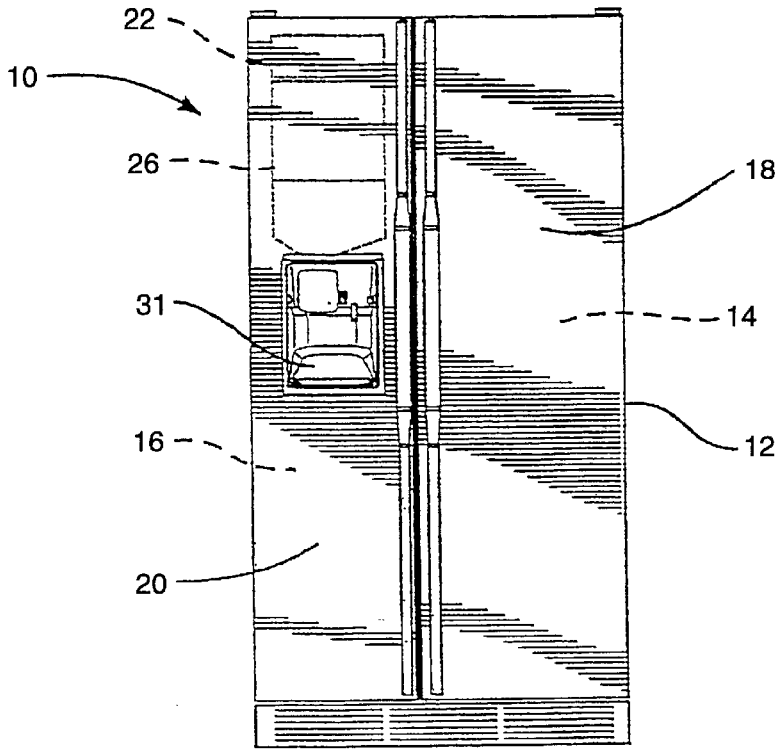
FIG. 1 is a front view of a refrigerator apparatus having an ice storing and dispensing system and a removable ice bucket.

In the illustrative embodiment of a refrigerator and an ice maker shown in FIGS. 1–3, a refrigerator 10, comprising a side-by-side fresh food/freezer configuration, is provided having a cabinet 12 forming an above freezing fresh food compartment 14 and a below freezing freezer compartment 16. Both the fresh food compartment 14 and the freezer compartment 16 are provided with access openings. A fresh food closure member or door 18 and a freezer closure member or door 20 are hingedly mounted to the cabinet 12 for closing the access openings, as is well known.

An ice making assembly 22 (FIGS. 2, 3 and 4) is disposed within the freezer compartment 16 having side walls 21 and 23 (see FIG. 4) and a top wall 24. The ice making assembly 22 is mounted to the inside surface of the top wall 24 of the freezer compartment 16. An ice dispensing system 26, mounted to the freezer door 20, is provided below the ice making assembly 22 for receiving ice pieces therefrom. The ice dispensing system 26 includes an ice bucket or bin 28, having an ice crushing system 30 both described later in greater detail. When operated, the ice dispensing system 26 transfers ice pieces from the bin 28 through the freezer door 20 whereby ice pieces may be dispensed through a conventional, forwardly exposed ice dispenser station or external ice service area 31.

The ice bucket of the present invention may be beneficially employed with any type of known ice maker. In the preferred embodiment, as shown in FIG. 4, the ice maker assembly 22 is a conventional ice piece making apparatus which forms crescent shaped ice pieces. The ice maker 22 includes an ice mold body 36, an ice stripper 38, a rotatable ejector (not shown) and a control module 40. The ice stripper 38 includes a ramp 38*a* for directing harvested ice into the ice storage bin 28. The ramp 38*a* may be integrally formed with the ice stripper, as shown, or may be a separate member. The control module surrounds a control motor (not shown) and gearing system (not shown) which operate to rotate the ejector when ice pieces are ready for harvesting. The ice makers disclosed in U.S. Pat. Nos. 4,649,717 and 5,160,094, herein incorporated by reference, are illustrative of the type of ice maker used in the present invention.

The ice maker 22 may be supported by a mounting bracket 42 along the upper, front portion of the freezer compartment 16. The mounting bracket 42 is attached to the top wall 24 (FIG. 3) of the freezer compartment and forms a member having a generally U-shaped cross section. The bracket 42 includes top mounting surfaces 43 which attach to the top wall 24. Side walls 44 extend downwardly along the sides of the ice maker 22. A bottom wall 46 joins the side walls 44 and forms a heat shield beneath the bottom of the ice maker 22. The ice maker 22 is attached to the mounting bracket 42 via mounting legs (not shown). An air baffle member 52 may be connected to the back of the ice maker 22 to direct the flow of air within the freezer compartment 16 across the ice mold 36 but is certainly not necessary to practice the present invention.

The manner in which the ice maker 22 is supported within the freezer compartment does not form part of the invention and may be readily varied—as can be appreciated by those skilled in the art. For example, the ice maker may be supported on bracket type elements extending from the side walls of the freezer compartment.

A front cover 50 (FIG. 3) is attached to the bracket in front of the ice maker 22. The front cover 50 is a generally flat member or wall having a back surface 52*a* and a front surface 52*b* and is pivotably supported in front of the ice maker 22. To pivotably support the cover 50, the bracket 42 may include tabs 48. A pair of support extensions 54 extending from the back surface 52*a* are rotatably captured by the tabs 48 and allow the cover 50 to swing or pivot about the tabs 48.

In the disclosed embodiment, when ice pieces are ready to be harvested from the ice mold body 36, the ejector and stripper 38 cooperate to remove ice pieces from the mold body 36 and urge the harvested ice pieces to slide forwardly along the stripper 38. The ice pieces slide forward off the stripper 38 and are directed to slide down the ramp 38*a*. The spacing between the back wall of the cover 50 and the bottom edge of the ramp 38*a* is such that ice pieces are not able to fit through the elongated gap which separates the ramp 38*a* and the cover 50. Accordingly, ice pieces sliding down the ramp 38*a* make contact with the cover 50. However, the mass of the ice pieces and the slope of the ramp 38*a* is such that the ice pieces push the cover 50 forward upon contact, rotating the cover 50 about the tabs 48, wherein the ice pieces are able to fall into the storage bin 28 which is supported by the freezer door 20.

The ice maker assembly 22 is designed to prevent ice harvesting when the ice storage bin 28 is full of ice pieces, when the door 20 is open, or when the ice bucket is removed from the door. The need for this function is well recognized in the ice maker art and a means for providing this function is described in detail in the parent applications.

2. Description of the Ice Bucket

Figure 9:
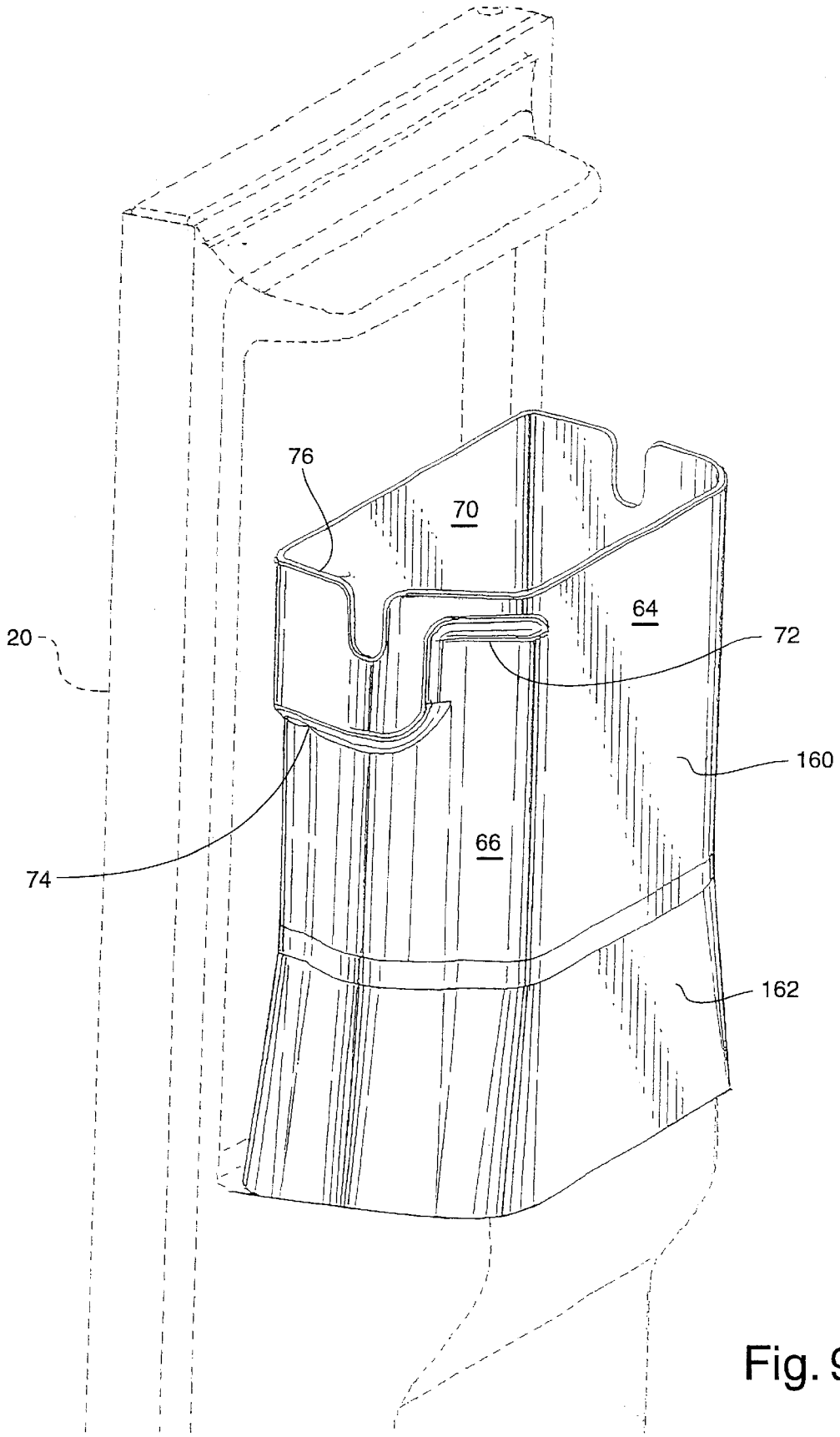
FIG. 9 is a left perspective view of the removable ice of the present invention.
Figure 10:
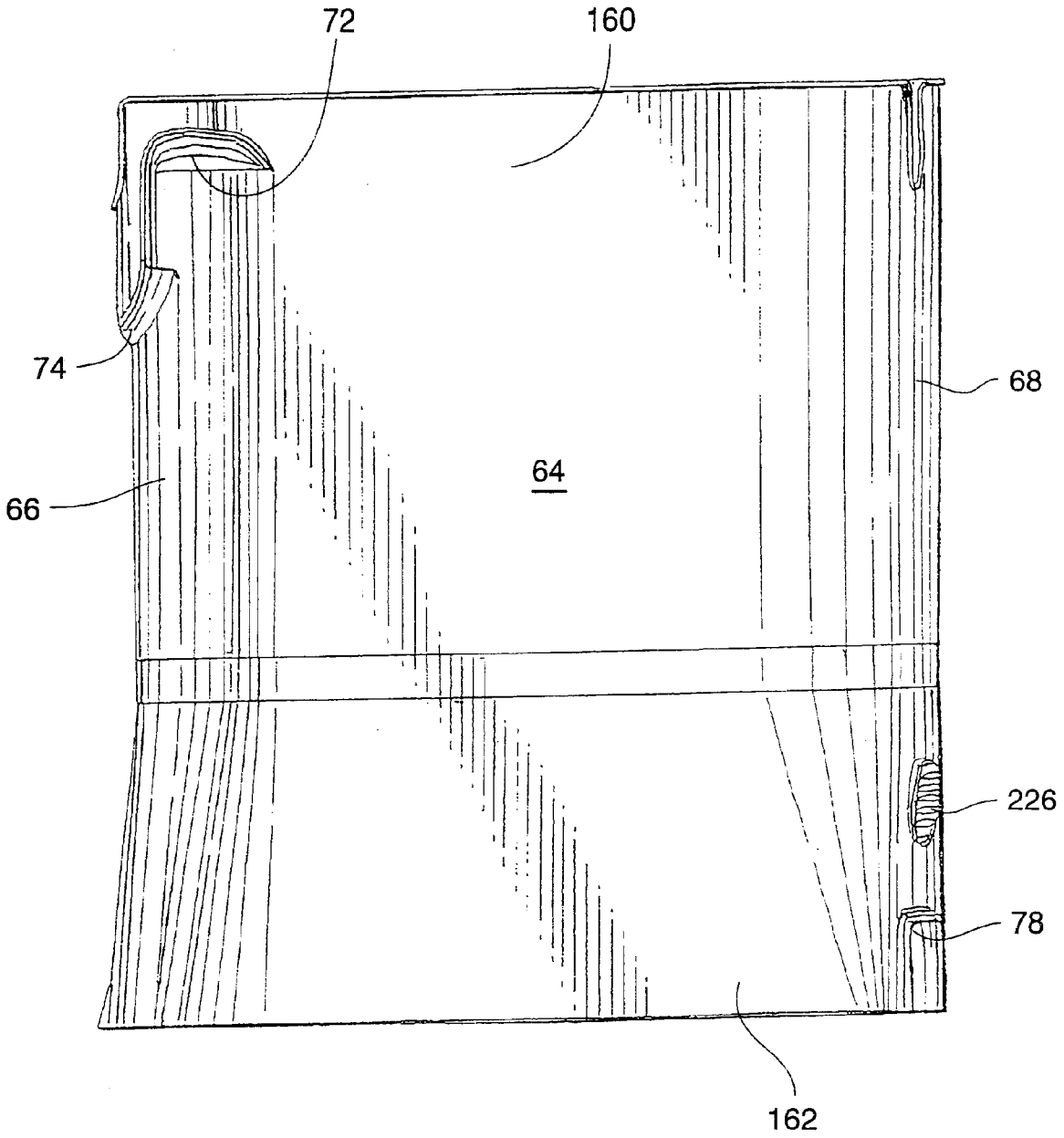
FIG. 10 is a front elevation view of a removable ice bucket of the present invention.

Referring now to FIGS. 9–10, the preferred embodiment of the ice bucket or bin 28 is illustrated. The ice bucket has preferably has a base 162 and an upper body 160. The upper body 160 has a plurality of vertical walls extending upwardly from the base member 162 including a front wall 64, side walls 66 and 68, and a back wall 70. Together with the base member, the walls define a hollow receptacle for collecting ice pieces from the ice maker assembly 22. The upper body 160 is formed from a clear plastic material such that the quantity of ice pieces stored within the ice bin 28 is easily visually determined, while the base 162 is preferably opaque to hide the mechanisms contained therein.

A contoured handle 72 and a spout 74 are formed at the uppermost portion of side wall 66 to facilitate lifting and dispensing of ice pieces from the ice bucket 28. Side wall 64 and handle 72 are preferably convex so as to comfortably cooperate with the palm a user lifting or tilting the ice bucket.

A second handle, preferably consisting if a cutaway portion 78 of the base member below side wall 68. This two handled configuration permits a user to reliably grip the ice bucket, on both sides and comfortably tilt it for dispensing the ice pieces stored therein through the spout into a glass or other point-of-use article.

Turning now back to FIGS. 3 and 5, the ice dispensing system 26 contained within the ice bucket 28 can be further explained.

The base 162 is rigidly connected to the upper body 160 and includes a funnel wall portion 164, a cylindrical wall portion 166 and a bottom wall portion 168. The bottom wall portion 168 includes an ice outlet opening 170 through which the ice pieces must pass to be dispensed.

Rotatably supported within the ice bucket 28 is an auger 172 having a shaped upper end 174 and a bottom shaft 176. The upper end 174 is supported within the upper ice bin member 160 and is designed to break up any large clumps of ice pieces which may be formed when ice pieces partially melt and then refreeze. Accordingly, rotation of the auger 172 ensures that the ice pieces are free to move downwardly, under the urgings of gravity, through the lower ice bin member and the ice crushing system 30 such that ice pieces may be dispensed. The upper end 174 of the auger 172 is also configured to avoid pushing ice pieces up and over the rim of the upper body 160.

As best seen in FIGS. 3 and 5, the bottom shaft 176 of the auger 172 is disposed within the lower ice bin member. The bottom shaft 176 is provided with a flat surface such that various parts may be assembled to the shaft for co-rotation therewith. The upper end 176*a* of the bottom shaft 176 is positioned within the funnel wall portion 164 and the bottom end 176*b* of the bottom shaft 176 extends through the bottom wall for coupling to a drive shaft 178. The coupling between the drive shaft 178 and the bottom shaft 176 may be accomplished through use of a coupling member.

Drivingly connected to the upper end 176*a* of the bottom shaft 176 is a bridge breaker blade 180. The bridge breaker blade 180 rotates above a blade cover 182. The blade cover 182 is a plate which is attached to the lower ice bin member at the junction between the funnel wall portion 164 and the cylindrical wall portion 166. The cover 182, together with the funnel wall portion 164, forms a bottom wall of the upper body 160. An inlet opening 184 is formed into the cover 182 through which ice pieces must pass to be discharged. The inlet opening 184 is positioned 180 degrees opposite of the outlet opening 170. As the auger 172 rotates, ice pieces are directed by the funnel wall portion 164 toward the inlet opening 184. The bridge breaker blade 180 ensures that the inlet opening 184 does not become jammed or bridged by ice pieces thereby preventing ice dispensing.

Once ice pieces pass through the inlet opening 184 they are disposed within a cylindrical ice crushing region 186 defined by the cylindrical wall portion 166, the cover 182 and the bottom wall portion 168. The bottom shaft 176 passes through the center of this region. Extending from the bottom shaft 176 are a plurality of ice crusher blades 188. The ice crusher blades 188 are connected to the bottom shaft for co-rotation therewith. A plurality of stationary blades 190 extend between the bottom shaft 176 and the cylindrical wall portion 166. The stationary blades 190 are positioned adjacent the side edge 170*a* of the ice outlet opening.

Rotation of the auger 172 causes the ice pieces to pass through the inlet opening 184 and fall into the ice crushing region 186. If the auger 172 is rotated counterclockwise, as shown by arrow 192, the ice pieces within the crushing region 186 are swept by the ice crushing blades 188 from the inlet opening 184 around within the crushing region 186 to fall through the outlet opening 170. The ice pieces move from the inlet opening 184 to the outlet opening 170 without having to pass through the stationary crusher blades. In this manner, when the auger 172 is rotated in the direction of arrow 192, whole ice pieces are dispensed though the outlet opening 170 and no ice crushing occurs.

If the auger 172 is rotated clockwise, as shown by arrow 194, the ice pieces within the crushing region 186 are swept by the ice crushing blades 188 from the inlet opening and are driven into the stationary ice crushing blades 190. The rotation of the auger 172 rotates the blades 188 past the stationary blades 190 resulting in the ice pieces being crushed. The crushed ice pieces, once past the stationary blades 190, fall through the outlet opening 170. In this manner, when the auger 172 is rotated in the direction of arrow 194, crushed ice pieces are dispensed though the outlet opening 170. Once the ice pieces, in either a whole or crushed form, are passed through the ice outlet opening 170, they fall through a chute 196 (FIG. 6) formed into the freezer door 20 to a waiting receptacle positioned within the service area 31.

While the dispensing of the ice pieces have been described with regard to the use of a plurality of crusher blades 188, the invention could readily be practiced with just one crusher blade 188 and one stationary blade 190. Moreover, the invention could dispense ice from the ice storage bin 28 without use of rotating and stationary crushing blades. For example, the rotary blades 188 and stationary blades 190 could be omitted and replaced with a paddle or other valving devices such as a pivotable or rotary door.

As just described, rotation of the auger 172 and the associated ice crusher blades 188 causes ice to be moved from the area of the upper ice bin member 160, through the ice inlet opening 184 and outlet opening 170 such that ice pieces are dispensed. The auger 172 is rotated by the drive shaft 178 which extends from a motor 200. The motor 200 is supported on the freezer door 20 below the ice service. The drive shaft 178 extends a relatively large distance between the motor and the ice bin 28.

Figure 6:
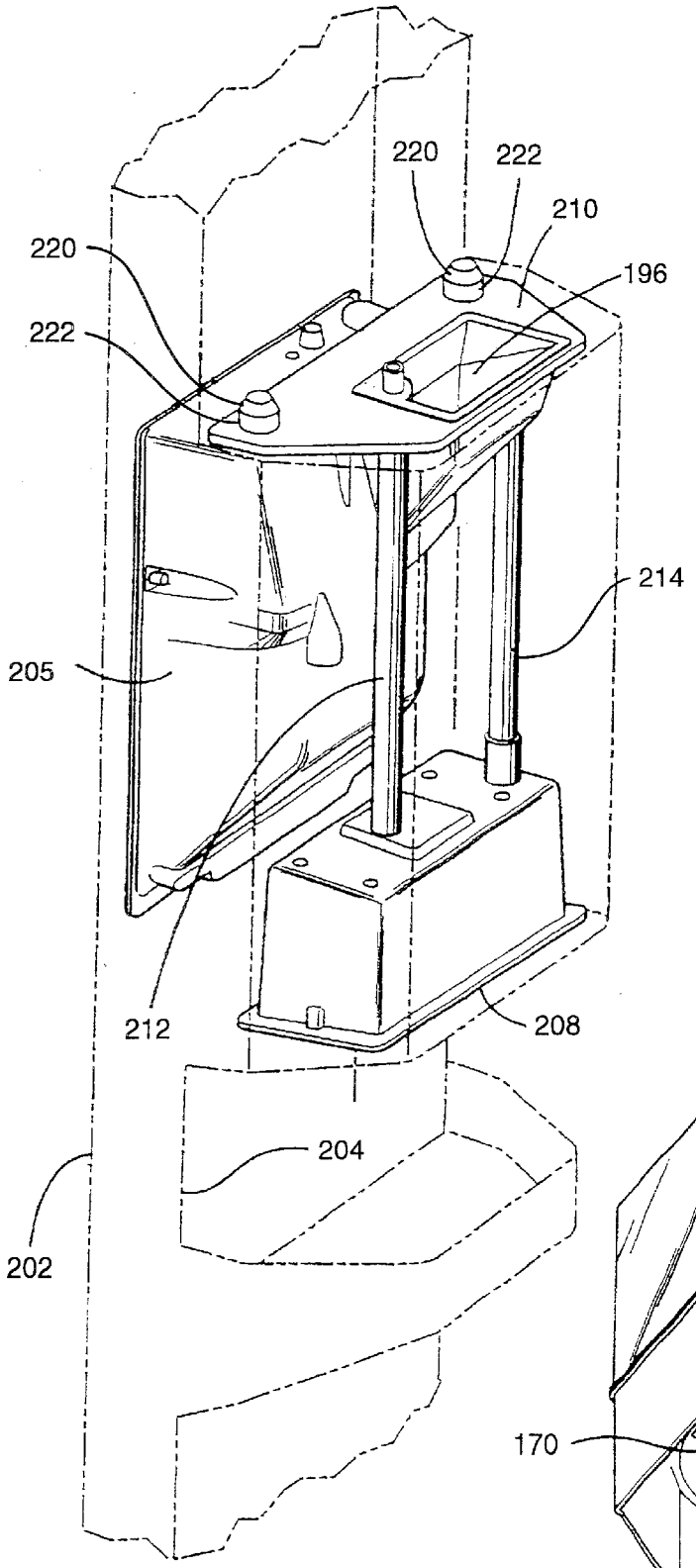
FIG. 6 is an enlarged, perspective view of the components of the ice storage and dispensing system of FIG. 1 mounted to the freezer door wherein the freezer door liner, wrapper and insulation have been removed.

To ensure proper operation of the ice delivery system of the present invention, it is important to rigidly and securely support the motor 200 and the ice bin 28 on the freezer door 20 since these parts must align for proper operation. The construction of the freezer door, as shown in FIGS. 3 and 6, provides the necessary strength and rigidity. The freezer door 20 comprises a metallic outer wrapper 202, an inner liner 204 with a foam material 206 disposed between the wrapper 202 and the liner 204. The ice service area 31 is formed by a service housing 205 which attaches to an opening in the wrapper 202. The fabrication of the door 20 may be such that the foam material 206 is foamed in place between the wrapper 202, the liner 204 and service housing 205 and bonds to the inner surfaces of the wrapper 202, liner 204 and service housing 205 providing a great deal of strength and rigidity.

FIGS. 3 and 6 illustrate the components used to support the motor and the ice storage bin 28. The motor 200 is mounted to a bracket 207 within a cup-shaped support member or housing 208 which is connected to the inner liner 204 prior to the foaming operation. A motor cover plate 209 is placed over the open end of the housing 208 after the motor is assembled to the door. The ice bin 28 is mounted to a mounting plate 210 which is connected to the inner liner 204. A conduit 212 extends between the mounting plate 210 and the housing 208 through which the drive shaft 178 can extend. A wiring conduit 214 is also connected to the motor housing 208 and extends upwardly to connect to the housing 205. In this manner, wiring can be routed between the motor 20 and controls placed in the ice service area 31.

Accordingly, it can be understood that that during fabrication of the freezer door 20, the housing 208, the mounting plate 210, the conduit 212 and the wiring conduit 214 are assembled to the inner liner 204 and then the foam 206 is foamed between the liner 204 and the wrapper 202 such that the components are bonded into position. Moreover, it can be readily appreciated by one skilled in the art that the conduits 212 and 214 may be integrally formed as part of the mounting plate 210 or the housing 208. Likewise, the mounting plate 210 or the housing 208 may be able to be integrally formed as part of the service housing 205.

Figure 7:
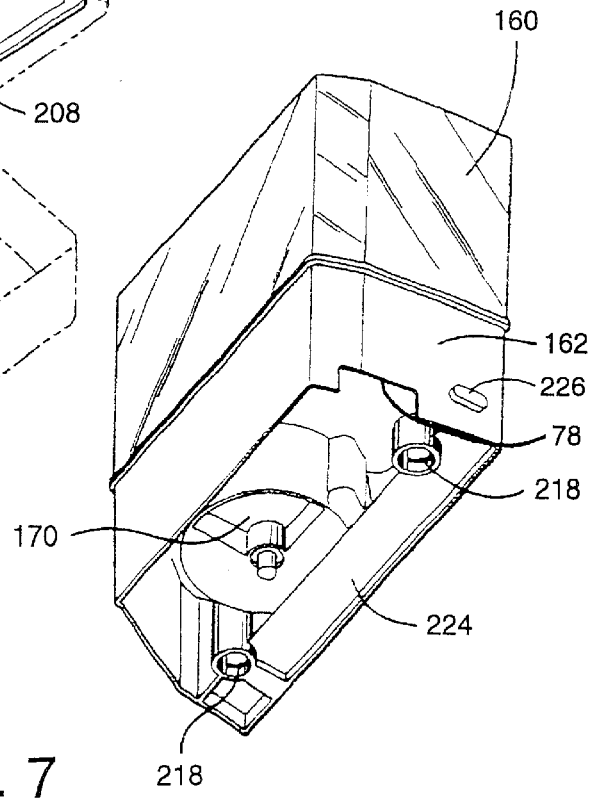
FIG. 7 is an enlarged, perspective view of the bottom of an ice bucket according to the present invention.
Figure 8:
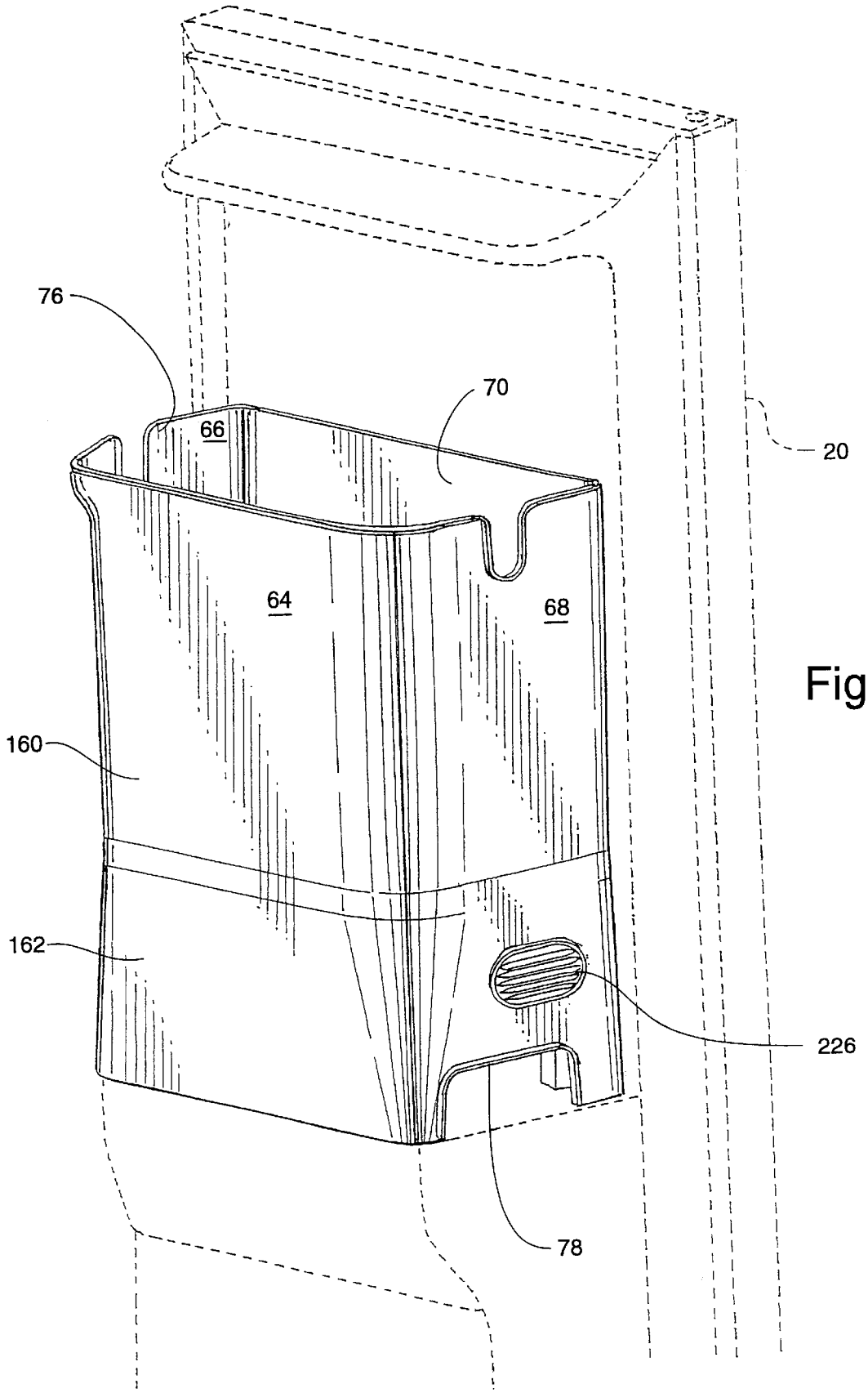
FIG. 8 is a right perspective view of the removable ice bucket of the present invention.

One of the benefits of the present invention is that the ice bin 28 is removable from the freezer door. This allows a user to readily remove the ice bin 28 and dump a large quantity of ice into a receptacle such as an insulated cooler. FIGS. 6, 7 and 8 best show how this is accomplished. The lower ice bin member 162 is provided with a pair of cylindrical bosses 218 or receptacles which correspond to mounting pins 220 provided on the mounting plate 210. When the ice storage bin 28 is properly set upon the mounting plate 210, the receptacles 218 and pins 220 align. Moreover, when the bin 28 is properly placed on the plate 210, the drive shaft 178 is coupled with the auger 172 and the ice outlet 170 is disposed over the chute 196.

Means are provided for securing the bin 28 to the mounting plate 210. Each of the pins 220 are provided with an annular groove 222. A retention bar 224 is slidingly supported by the lower ice bin member 162. A button 226, connected to the bar 224, is provided for longitudinally moving the retention bar 224 which is biased toward the button 226. The retention bar 224 has a pair of cut out portions (not shown) corresponding to the grooves 222. When the bin 28 is placed onto the mounting plate 210, the pins 220 are received into the receptacles 218 and the cut out portions of the retention bar 224 are engaged into the grooves 222 provided on the pins 220. When it is desired to remove the bin 28, the button 226 is depressed such that the cut out portions of the retention bar 224 are disengaged from the grooves 222, allowing separation between the plate 210 and the base 162.

It will be appreciated that the button 226 is advantageously disposed near the second handle 78 so that the button 226 can be easily depressed to release the ice bucket from the door 20 at the same time as the handle is gripped to lift it.

It can be seen, therefore, that the present invention provides an easy and sanitary means for removing an ice bucket from a refrigerator, dispensing ice pieces at the point of use, and reinstalling the ice bucket in the refrigerator. The ice bucket of the present invention is compatible, as described above, with through-the-door ice making systems. Moreover, the present system is beneficially combined with an in-door ice maker that automatically detects removal of the ice bucket and temporarily deactivates the ice maker.

Many changes can readily be made to the above described embodiments without departing from the scope of the claims. For example, a similar ice bucket may configures for use with an ice maker in a top mount refrigerator.

The present invention is not intended to be limited by any particular geometric configuration for the ice bucket and can be beneficially employed with any type of ice maker.

Accordingly, while the present invention has been described with reference the above described embodiment, those of skill in the Art will recognize that changes may be made thereto without departing from the scope of the invention as set forth in the appended claims.

We claim:

1. An ice bucket for use in a conjunction with a refrigerator having a freezer compartment, a door for selectively closing the freezer compartment, an ice maker disposed within the freezer compartment for forming ice pieces, said ice bucket comprising:

a main body having a base removably mounted to said door below said ice maker for receiving ice pieces from said ice maker, and a plurality of vertical walls extending upwardly from said base defining there between an ice storage bin for collection and storage of said ice pieces received from said ice maker, said main body including a pair of outer side walls disposed opposite each other and generally perpendicular to said door when said ice bucket is mounted to said door, a first handle formed in an upper portion of a first of said side walls, a second handle formed in a lower portion of a second of said side walls, and spout means formed integrally in said first side wall above said first handle such as to direct the flow of ice pieces being dispensed from said ice bucket.

2. The ice bucket according to claim 1, wherein said second handle comprises a cut-away in said base permitting the user to insert on or more fingers below said second side wall for removal of said ice bucket from said door, dispensing of said ice pieces, and reinstallation of said ice bucket to said door.

3. An ice bucket for use in a conjunction with a refrigerator having a freezer compartment, a door for selectively closing the freezer compartment, an ice maker disposed within the freezer compartment for forming ice pieces, said ice bucket comprising:

a main body having a base removably mounted to said door below said ice maker for receiving ice pieces from said ice maker, and a plurality of vertical walls extending upwardly from said base defining there between an ice storage bin for collection and storage of said ice pieces received from said ice maker, said main body including a pair of outer side walls disposed opposite each other and generally perpendicular to said door when said ice bucket is mounted to said door, a first handle formed in an upper portion of a first of said side walls, and a second handle formed in a lower portion of a second of said side walls, wherein said first handle is a downwardly oriented convex surface and is formed to cooperate with the thumb and first finger of a user for facilitating removal of said ice bucket from said door and tilting of said ice bucket for dispensing of ice pieces therefrom.

4. An ice bucket for use in a conjunction with a refrigerator having a freezer compartment, a door for selectively closing the freezer compartment, an ice maker disposed within the freezer compartment for forming ice pieces, said ice bucket comprising:

a main body having a base removably mounted to said door below said ice maker for receiving ice pieces from said ice maker, and a plurality of vertical walls extending upwardly from said base defining there between an ice storage bin for collection and storage of said ice pieces received from said ice maker, said main body including a pair of outer side walls disposed opposite each other and generally perpendicular to said door when said ice bucket is mounted to said door, a first handle formed in an upper portion of a first of said side walls, and a second handle formed in a lower portion of a second of said side walls, wherein said main body is comprised of an opaque lower main body comprising said base and a transparent upper main body comprising the upper portions of said side walls.

5. An ice bucket for use in a conjunction with a refrigerator having a freezer compartment, a door for selectively closing the freezer compartment, an ice maker disposed within the freezer compartment for forming ice pieces, said ice bucket comprising:

a main body having a base removably mounted to said door below said ice maker for receiving ice pieces from said ice maker, and a plurality of vertical walls extending upwardly from said base defining there between an ice storage bin for collection and storage of said ice pieces received from said ice maker, said main body including a pair of outer side walls disposed opposite each other and generally perpendicular to said door when said ice bucket is mounted to said door, a first handle formed in an upper portion of a first of said side walls, and a second handle formed in a lower portion of a second of said side walls, wherein said base further comprises:

latching means for selectively interconnecting said ice bucket with said door, and a release for selectively releasing said latch means for removal of said ice bucket from said door.

6. The ice bucket according to claim 5, wherein said latching means automatically engages with said door when said ice bucket is reinstalled in said door and said release comprises a button disposed adjacent said second handle for manual release of said latching means.

7. An ice bucket comprising a main body including a base having outer walls, a plurality of vertical walls extending upwardly from each of said outer walls of said base and cooperating with said base to define an ice storage bin for collection of ice, a first handle formed in an upper portion of a first of said side walls, a second handle formed in a lower portion of a second of said side walls, and spout means formed integrally in said first side wall above said first handle such as to direct the flow of ice pieces being dispensed from said ice bucket.

8. The ice bucket according to claim 7, wherein said second handle comprises a cut-away in said second side wall permitting the user to insert one or more fingers below said second side wall for dispensing of ice pieces therefrom.

9. The ice bucket according to claim 8, further wherein said first handle is a downwardly oriented convex surface is formed to cooperate with the thumb and first finger of a user for facilitating lifting of said ice bucket and tilting of said ice bucket for dispensing of ice pieces therefrom.

10. An ice bucket comprising a main body including a base having outer walls, a plurality of vertical walls extending upwardly from each of said outer walls of said base and cooperating with said base to define an ice storage bin for collection of ice, a first handle formed in an upper portion of a first of said side walls, and a second handle formed in a lower portion of a second of said side walls, wherein said first handle is a downwardly oriented convex surface and is formed to cooperate with the thumb and first finger of a user for facilitating lifting and tilting of said ice bucket for dispensing of ice pieces therefrom.

11. An ice bucket comprising a main body including a base having outer walls, a plurality of vertical walls extending upwardly from said each of said outer walls of said base and cooperating with said base to define an ice storage bin for collection of ice, a first handle formed in an upper portion of a first of said side walls, and a second handle formed in a lower portion of a second of said side walls, wherein said main body is comprised of an opaque lower main body comprising said base and a transparent upper main body comprising the upper portions of said side walls.

12. An ice bucket for use in a conjunction with an ice maker disposed within the freezer compartment for forming ice pieces, said ice bucket comprising:

a main body having a base removably mounted to said refrigerator in said freezer compartment below said ice maker for receiving ice pieces from said ice maker, and a plurality of vertical walls extending upwardly from said base defining there between an ice storage bin for collection and storage of said ice pieces received from said ice maker, said main body including a pair of outer side walls disposed opposite each other and generally perpendicular to said door when said ice bucket is mounted to said door, a first handle formed in an upper portion of a first of said side walls, and a second handle formed in a lower portion of a second of said side, wherein said first handle is a downwardly oriented convex surface is formed to cooperate with the thumb and first finger of a user for facilitating removal of said ice bucket from said door and tilting of said ice bucket for dispensing of ice pieces therefrom.

13. The ice bucket according to claim 12, further comprising spout means formed integrally in said first side wall above said first handle such as to direct the flow of ice pieces being dispensed from said ice bucket.

14. The ice bucket according to claim 12, wherein said second handle comprises a cut-away in said base permitting the user to insert on or more fingers below said second side wall for lifting of said ice bucket and dispensing of said ice pieces.

15. The ice bucket according to claim 12, wherein said main body is comprised of an opaque lower main body comprising said base and a transparent upper main body comprising the upper portions of said side walls.

16. The ice bucket according to claim 12, wherein said base means further comprises:

latching means for selectively interconnecting said ice bucket with said refrigerator, wherein said latching means automatically engages with said door when said ice bucket is reinstalled in said door and a release for selectively releasing said latch means for removal of said ice bucket from said door.

* * * * *